US012174004B2

(12) United States Patent
Thompson

(10) Patent No.: US 12,174,004 B2
(45) Date of Patent: Dec. 24, 2024

(54) MULTI-CONFIGURATION TRANSPORTABLE DEMOLITION POUCH

(71) Applicant: The United States of America, as represented by the Secretary of the Navy, Crane, IN (US)

(72) Inventor: Clayton Andrew Thompson, Bedford, IN (US)

(73) Assignee: The United States of America, Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 18/204,610

(22) Filed: Jun. 1, 2023

(65) Prior Publication Data

US 2023/0400289 A1 Dec. 14, 2023

Related U.S. Application Data

(60) Provisional application No. 63/348,133, filed on Jun. 2, 2022.

(51) Int. Cl.

| | |
|---|---|
| ***F42D 5/04*** | (2006.01) |
| ***F42D 3/02*** | (2006.01) |
| ***F42D 5/045*** | (2006.01) |

(52) U.S. Cl.

CPC ..... *F42D 5/045* (2013.01); *F42D 3/02* (2013.01)

(58) Field of Classification Search

CPC .. F42D 5/045; F42D 3/02; F42B 3/087; F42B 3/26

See application file for complete search history.

(56) References Cited

U.S. PATENT DOCUMENTS 3,064,569 A * 11/1962 Rosenthal ..... F42B 39/00 220/6
3,472,166 A * 10/1969 Dowling ..... F42B 3/087 102/318
3,645,205 A * 2/1972 Dowling ..... F42B 3/087 102/318
3,789,760 A * 2/1974 Griffith ..... F42B 3/26 102/306
4,133,247 A * 1/1979 Calder, Jr. ..... C06C 5/06 102/304
4,141,296 A * 2/1979 Calder, Jr. ..... F42D 1/10 102/318

(Continued)

*Primary Examiner* — Joshua E Freeman

(74) *Attorney, Agent, or Firm* — Naval Surface Warfare Center, Crane Division; Christopher Feigenbutz

(57) ABSTRACT

Provided is a multi-configuration transportable demolition pouch that includes a cruciform shaped section of fabric with a central explosive containing area and four trimmable flaps, a fastener on each of the flaps, a strap accepting slit, a first and a second strap, a fabric lid and priming hole, and one or more energetic device that can be selected based on desired blast footprint. The pouch can be trimmed when using smaller quantities of explosives to reduce its footprint and facilitate ease of carrying and emplacement. The device has attachment features to aid in transport and to provide proper spacing and attachment points for demolitions and breeching techniques involving multiple charges. The pouch provides components to allow for blast footprint alteration and for water tamping to reduce blast effects to nearby personnel, as well as to increase the efficiency of the explosive charge.

3 Claims, 9 Drawing Sheets

(56) References Cited

U.S. PATENT DOCUMENTS

| | | | | | |
|---|---|---|---|---|---|
| 4,167,139 | A * | 9/1979 | Gleason | F42D 1/06 | 102/275.3 |
| RE30,621 | E * | 5/1981 | Calder, Jr. | F42D 1/04 | 102/275.3 |
| 8,186,505 | B1 * | 5/2012 | Saucedo | F42B 39/14 | 190/127 |
| 11,982,079 | B1 * | 5/2024 | Foltz | F16B 7/00 | |
| 2023/0400289 | A1 * | 12/2023 | Thompson | F42D 5/045 | |
| 2024/0044632 | A1 * | 2/2024 | Ulken | F42B 39/20 | |

* cited by examiner

MULTI-CONFIGURATION TRANSPORTABLE DEMOLITION POUCH

CROSS-REFERENCE TO RELATED APPLICATIONS

The present application claims priority to U.S. Provisional Patent Application Ser. No. 63/348,133, filed Jun. 2, 2022, entitled "MULTI-CONFIGURATION DEMOLITION POUCH," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 210303US02) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to storage pouches. More particularly, it pertains to a multi-configuration transportable demolition pouch to facilitate and expedite loading of conventional and common issue high explosives into multiple useful configurations that can be easily transported before or after assembly.

BACKGROUND

High-explosives are often used in military applications. These explosives can be wrapped together and used as a bulk charge. This requires the explosives to be packaged in a manner that affords ease of transport to a desired location and detonation. Old methods involved using duct tape to fabricate charges and did not provide provisions for transport or focused blasts. Additionally, duct tape fabricated pouches require considerable time to fabricate, are difficult to consistently produce, and have poor reliability. As is clear from the above, it is evident that a new system for carrying varied weights of commonly issued high-explosive as a bulk charge or configured for a focused blast is needed.

SUMMARY OF THE INVENTION

The present invention relates to a multi-configuration transportable demolition pouch that is capable of carrying varied weights of commonly issued high-explosive as a bulk charge or configured for a focused blast effect. The pouch can be physically trimmed when using smaller quantities of explosives to reduce its footprint and facilitate ease of carrying and emplacement. The inventive device has provisions to aid in transport of a loaded pouch, provide proper spacing and attachment points for demolitions and breeching techniques involving multiple charges, provides proper initiation location, and includes components to allow for water tamping to reduce blast effects to nearby personnel, as well as increase the efficiency of the explosive charge.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is a multi-configuration transportable demolition pouch comprising: a cruciform shaped section of fabric comprising a central explosive containing area and four trimmable flaps; a fastener on each of the trimmable flaps; a strap accepting slit positioned at a junction between each of the trimmable flaps and the central explosive containing area; a first and a second strap; a fabric lid comprising a fastener and a centered priming hole; and a first energetic device comprising a packed explosive, a sheet explosive, and a detonation cord wrapped around and secured to the sheet explosive; or a second energetic device comprising, in order, a packed explosive, a first sheet explosive, a wave shaper, a second sheet explosive, and a detonation cord wrapped around and secured to the second sheet explosive; wherein the first or the second energetic device is placed in the central explosive containing area, the trimmable flaps are trimmed to secure the first energetic device in the central explosive containing area in a pouch configuration, the fabric lid is positioned on top of the trimmable flaps, the detonation chord is passed through the centered priming hole, and the straps are passed through the strap accepting slits and tightened; wherein the first energetic device, when detonated, provides a central detonation point causing hemispherical detonation wave propagation to produce an expanding blast zone; and wherein the second energetic device, when detonated, the wave shaper creates an interrupted hemispherical detonation wave that causes detonation propagation to travel to outer edges of the packed explosive to produce a reduced footprint blast zone.

In an illustrative embodiment, the multi-configuration transportable demolition pouch further comprises one or more attachment features. In an illustrative embodiment, the wave shaper can be immersed in water to provide water tamping to reduce blast effects.

In an illustrative embodiment, the inventive pouch is capable of carrying varied weights of commonly issued high-explosive in a bulk charge configuration or in a focused blast configuration. The pouch can be assembled based on desired configuration and physically trimmed when using smaller quantities of explosives to reduce its footprint, which further facilitates ease of carrying and emplacement.

Figure 1:
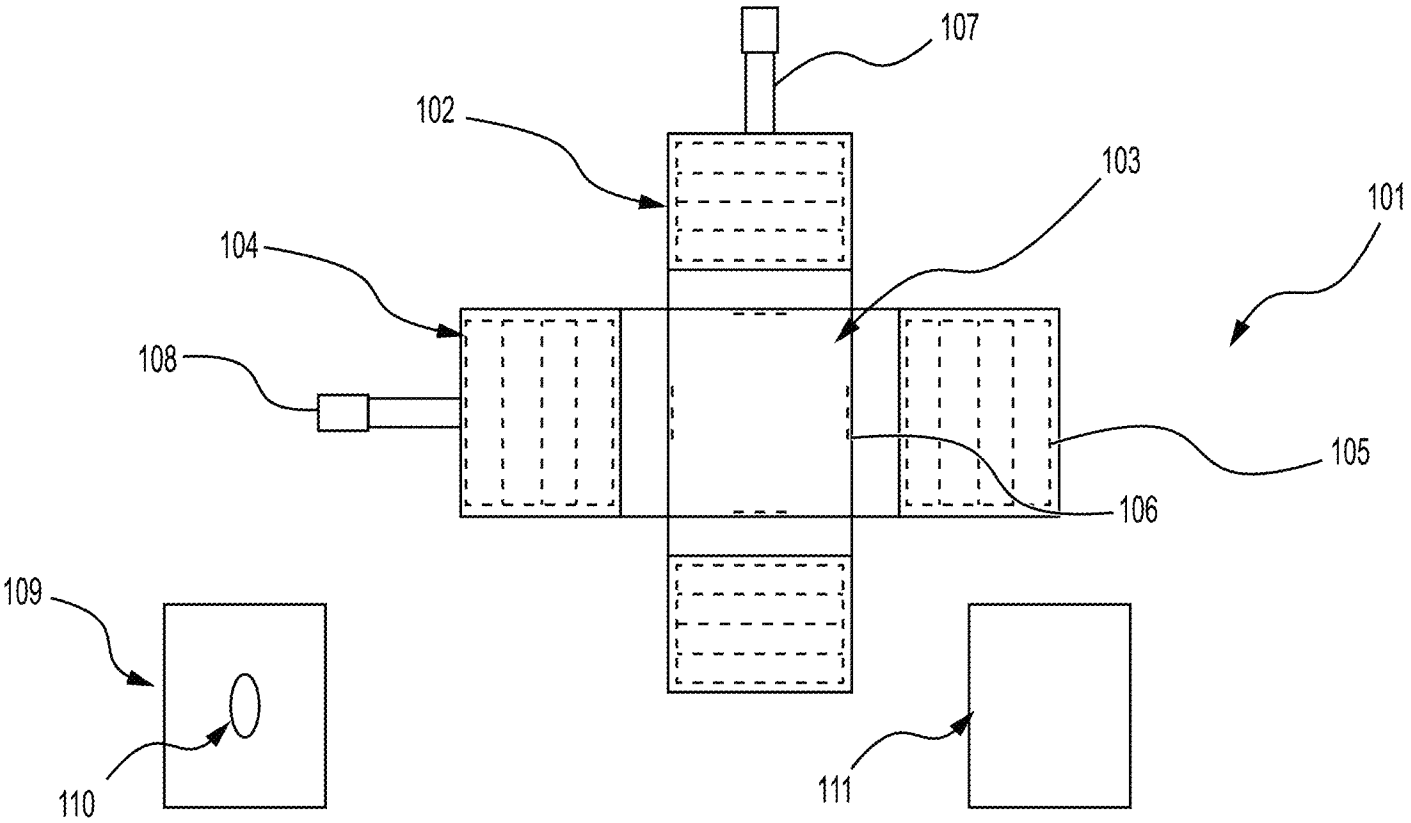
FIG. 1 shows views of the pouch interior with components.

FIG. 1 shows views of the pouch interior with components. The multi-configuration transportable demolition pouch 101 comprises a cruciform shaped section of fabric 102 comprising a central explosive containing area 103 and four trimmable flaps 104; a fastener 105 on each of the trimmable flaps 104; a strap accepting slit 106 positioned at a junction between each of the trimmable flaps 104 and the central explosive containing area 103; a first and a second strap 107, 108; a fabric lid 109 comprising a fastener and a centered priming hole 110; and an energetic device (explosives). In an illustrative embodiment, the flaps 104 are covered with a fastening means, preferably hook and loop that is stitched over a portion thereof. The slits 106 are positioned at the junction between each flap 104 and the central area 103, which allows the straps 107, 108 to be threaded therethrough for closing the pouch 101. The fabric lid 109 is covered with a fastening means, preferably hook and loop, and further includes a centered priming hole 110. In an illustrative embodiment, a wave shaper 111, preferably constructed of an open cell foam insert is sized to fit within the pouch 101 to prevent excessive shock from interfering with the explosives before detonation.

Figure 2:
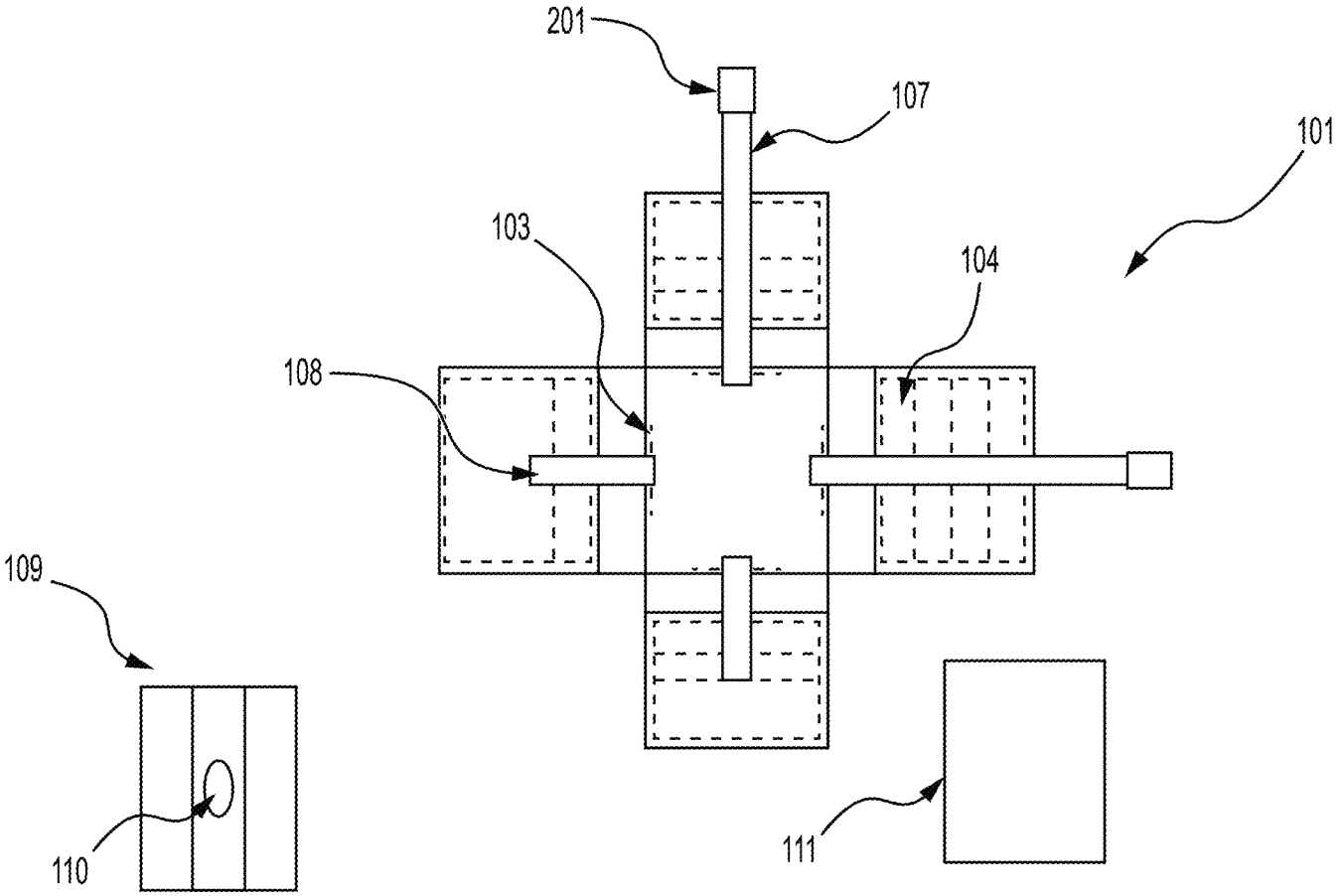
FIG. 2 shows views of the pouch exterior with components.

FIG. 2 shows views of the pouch 101 exterior with components. The straps 107, 108 as shown are inserted through the slits 106. In an illustrative embodiment, two straps can be used, with a first strap 107 running vertically and a second strap 108 running horizontally. In an illustrative embodiment, the straps 107, 108 include an attachment means, preferably a clip 201 on a first end thereof. The clip secures the first end of the strap to the second end to close the pouch 101 and secure the energetic device therein. In a closed configuration (shown in greater detail below) the straps 107, 108 close the pouch 101 to form a box shape with the energetic device contained therein. In an illustrative embodiment, the flaps 104 can be trimmed or cut to decrease the volume of the pouch 101 for smaller quantities of explosives.

Figure 3:
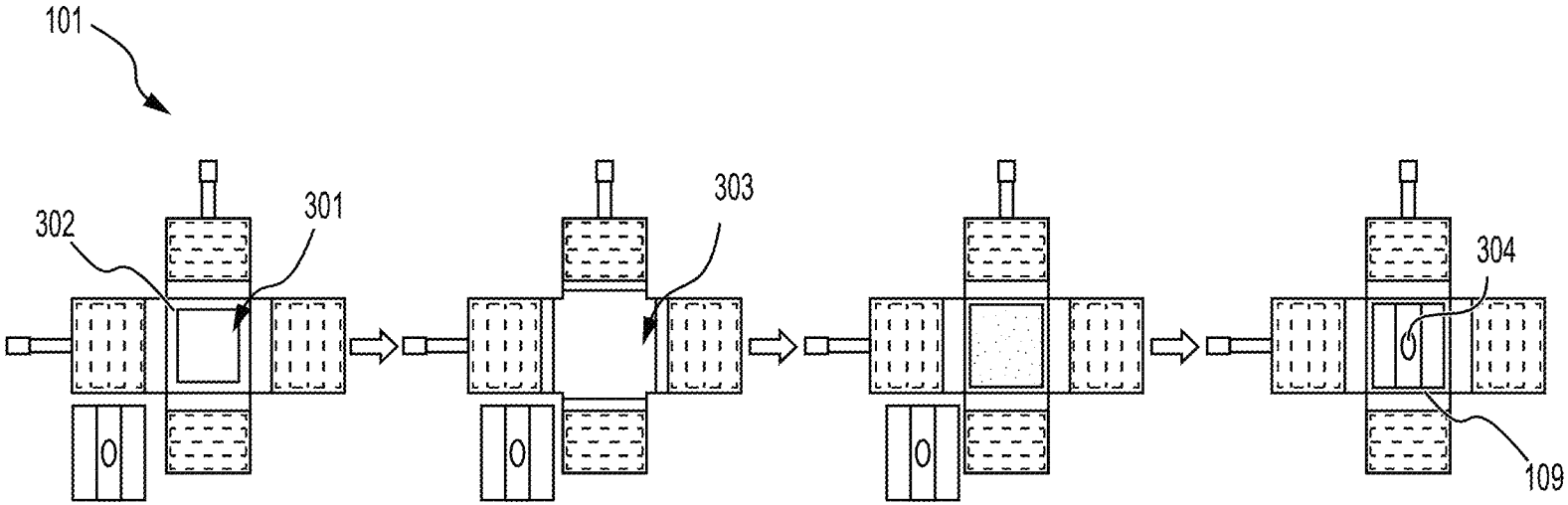
FIG. 3 shows views of the pouch in bulk configurations.

FIG. 3 shows views of the pouch 101 in bulk configurations. In an illustrative embodiment, the pouch 101 can be filled with various configurations of explosives 301. In an illustrative embodiment, the pouch 101 can contain a first energetic device comprising a packed (C4) explosive 302, a sheet (C2 #1) explosive 303, and a detonation (DET) cord 304 wrapped around and secured to the sheet explosive 303. The pouch 101 can contain a variety of energetic devices or explosives. In an illustrative embodiment, C4 explosive 302 is used, wherein packed C4 302 can be placed on the pouch 101. The quantity of C4 302 can vary and the pouch can be trimmed for smaller quantities. In an illustrative embodiment, the pouch 101 can contain a C4 302 explosive and a C2 #1 sheet 303 formed into a secure block with a DET cord 304 explosive attached thereto. The DET cord 304 is spiral wrapped and taped to the C2 #1 sheet 303 in the center to ensure detonation. The fabric lid 109 with priming hole 110 is then placed on top of primed C2 #1 sheet 303. In an illustrative embodiment, the pouch 101 can be trimmed to size prior to closing the pouch 101 after priming.

Figure 4:
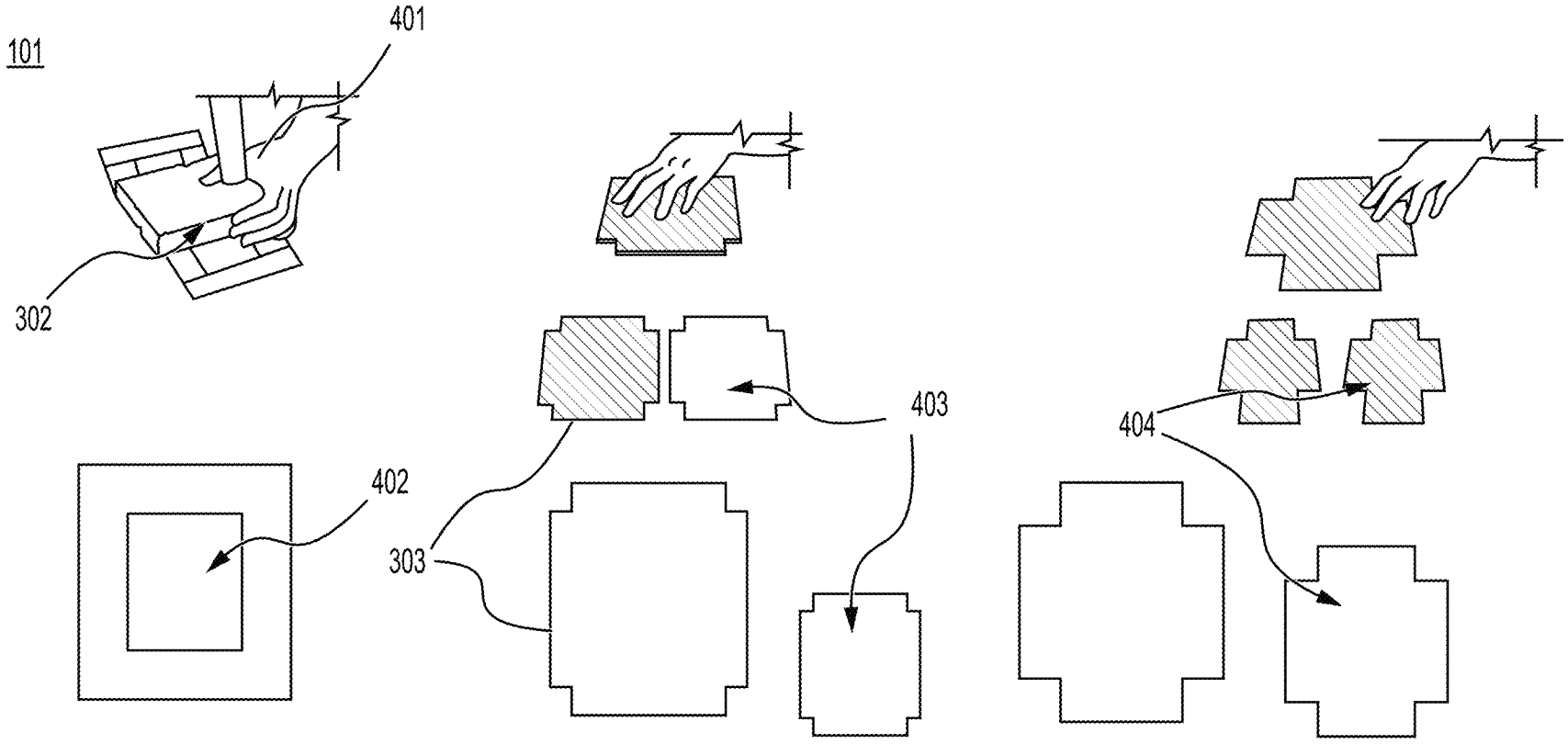
FIG. 4 shows a view of the explosive prep setup.

FIG. 4 shows a view of the explosive prep setup. In an illustrative embodiment, C4 302 is packed to remove air gaps and to ensure proper size and shape using a wooden dowel 401 or non-sparking tool. As can be appreciated, a C4 mold 402 can be used to facilitate the process. In an illustrative embodiment, C2 #1 primasheet template 403 can be used to cut C2 Sheet Explosive 303 to proper size. Also shown herein are the C4 mold 402, the C2 #1 primasheet template 403, and a C2 #2 primasheet template 404.

Figure 5A:
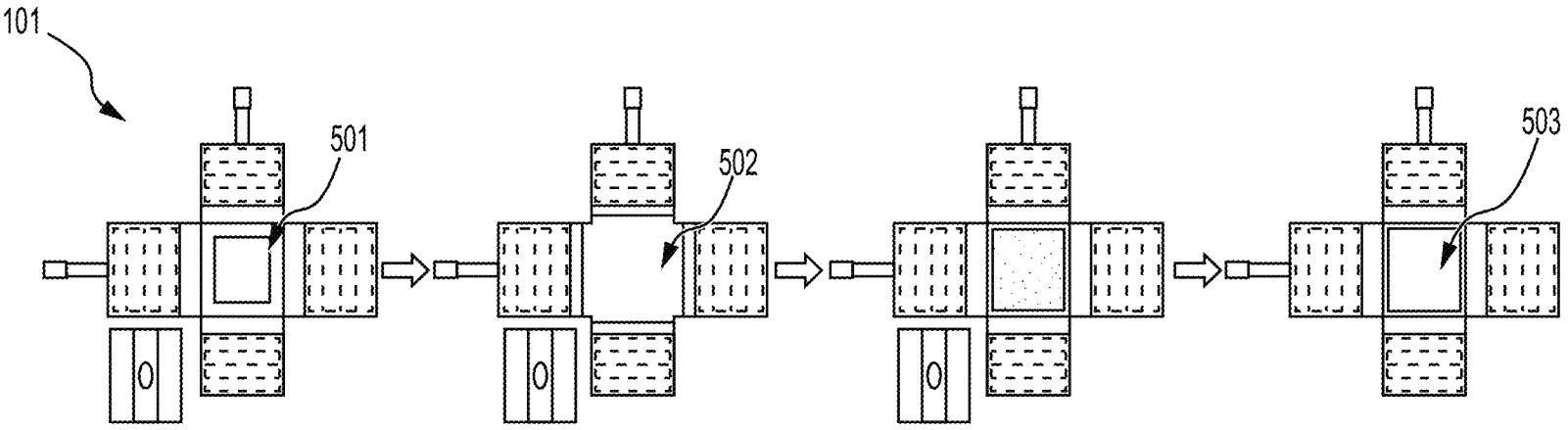
FIG. 5A shows views of the pouch in focused blast configurations.
Figure 5B:
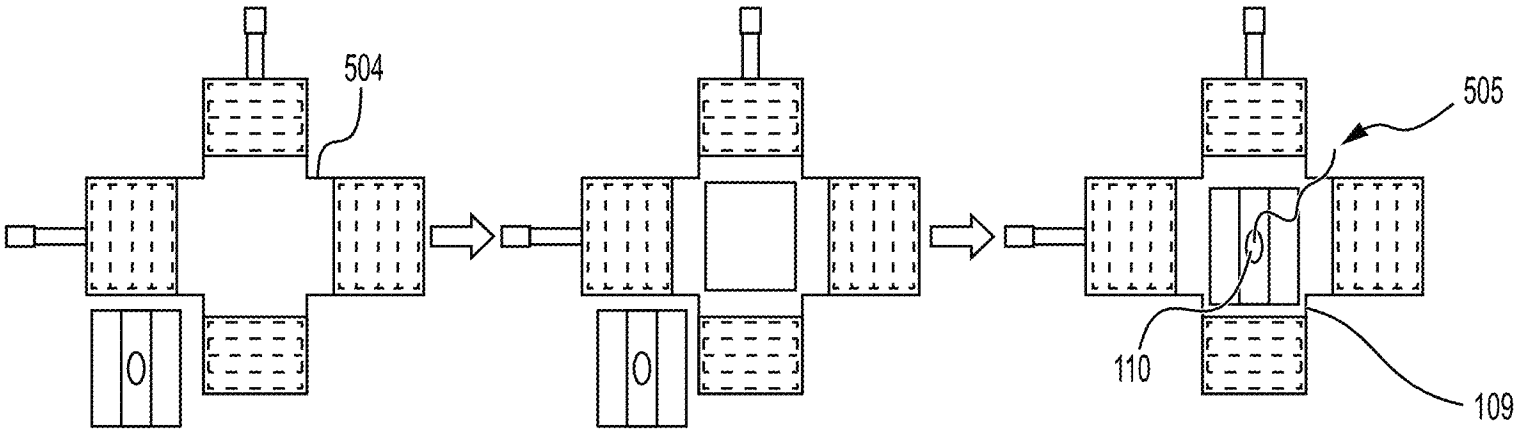
FIG. 5B shows views of the pouch in focused blast configurations.

FIGS. 5A and 5B show views of various configurations of the pouch in focused blast configurations. In an illustrative embodiment, the pouch 101 can contain a second energetic device comprising, in order, a packed (C4) explosive 501, a first sheet (C2 #1) explosive 502, a wave shaper 503, a second sheet (C2 #2) explosive 504, and a detonation cord 505 wrapped around and secured to the second sheet explosive 504. In an illustrative embodiment, packed C4 501 is placed on pouch. The quantity of C4 501 can vary and the pouch may need to be trimmed for smaller quantities. In an illustrative embodiment, C2 #1 502 is laid on top of C4 501, C2 #1 502 is taped to form a secure block, and an open cell foam wave shaper 503 is then laid on top of C2 #1 502. In an illustrative embodiment, the open cell foam wave shaper 503 can be wrapped in a plastic bag and filled with water to provide water tamping. In an illustrative embodiment, C2 #2 504 is laid on top of wave shaping foam 503 and taped directly onto C2 #1 502 to ensure proper explosive to explosive contact. In an illustrative embodiment, the DET cord 505 is spiral wrapped and taped to C2 502, 504 in the center to ensure detonation. The fabric lid 109 with priming hole 110 is then placed on top of primed C2 502, 504, and trim procedures are followed prior to closing pouch after priming.

Figure 6:
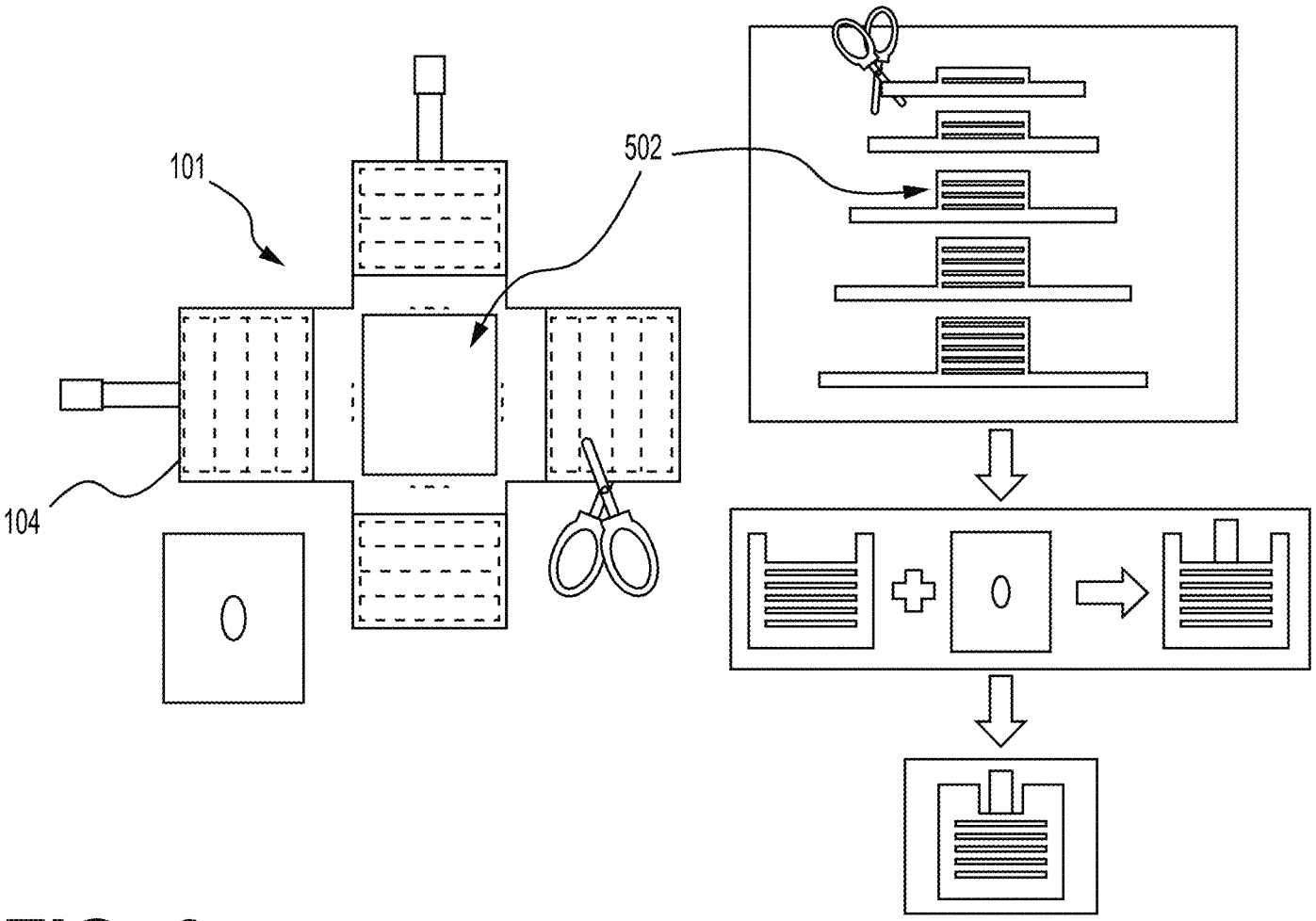
FIG. 6 shows trimming instructions for the multi-configuration demolition pouch.

FIG. 6 shows trimming instructions for the multi-configuration demolition pouch 101. In an illustrative embodiment, the pouch 101 is trimmed to fit prior to closing when using reduced quantities of C4 502 to prevent flaps 104 from impeding the priming hole 110. Also shown herein are the variable layer heights and explosive weights.

Figure 7:
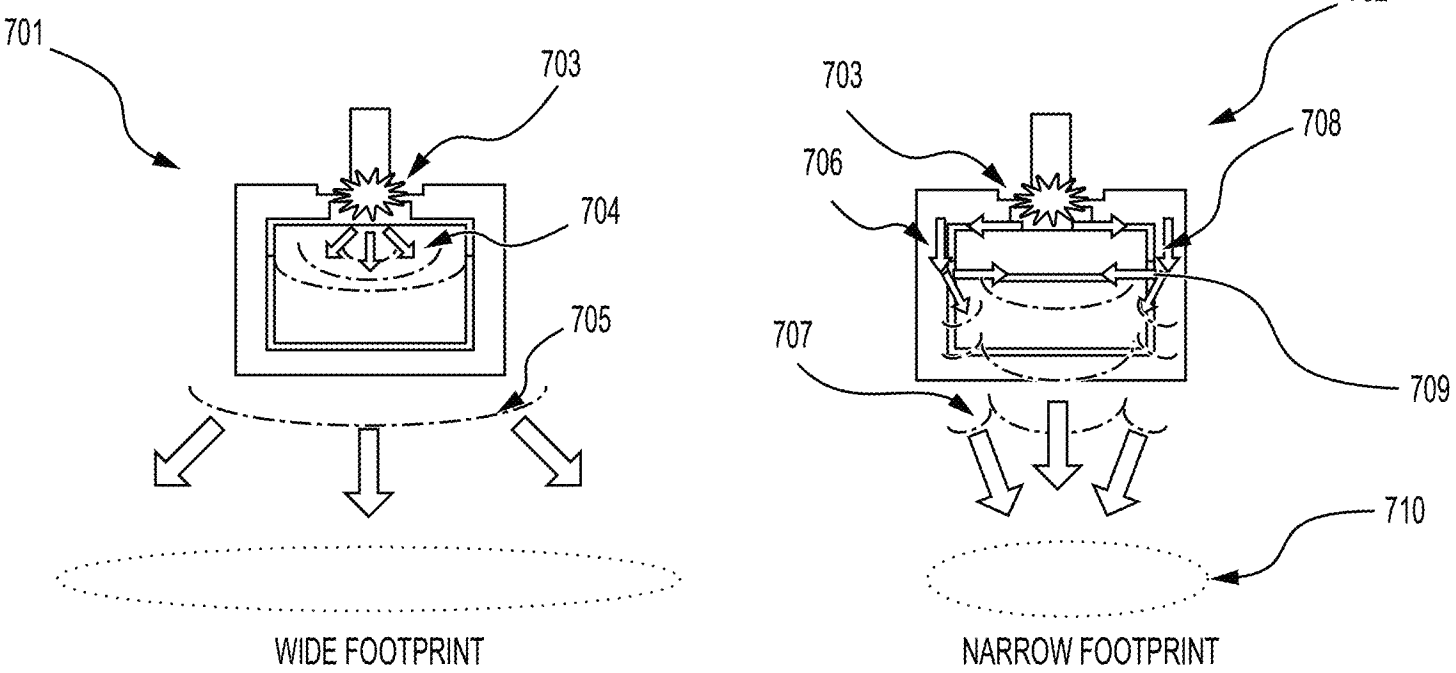
FIG. 7 shows a view of the bulk vs. focused blast configuration effects.

FIG. 7 shows a view of the bulk 701 vs. focused 702 blast configuration effects. In bulk configuration 701 (first energetic device), detonation provides a central detonation point 703 causing hemispherical detonation wave propagation 704 to produce an expanding blast zone 705. In focused blast configuration 702 (second energetic device), detonation, with the assistance of the wave shaping foam 706, provides an interrupted hemispherical detonation wave 707 that causes detonation propagation 708 to travel to the outer edges 709 of the packed explosive to produce a reduced footprint blast zone 710. The wave shaping foam 706 interrupts the hemispherical detonation wave, which causes the detonation propagation to travel to the outer edges 709 of the packed C4 explosive, thus creating a self-tamped detonation propagation of increased pressure. As can be appreciated, the tradeoff is a reduced footprint area in lieu of deeper penetration.

Figure 8:
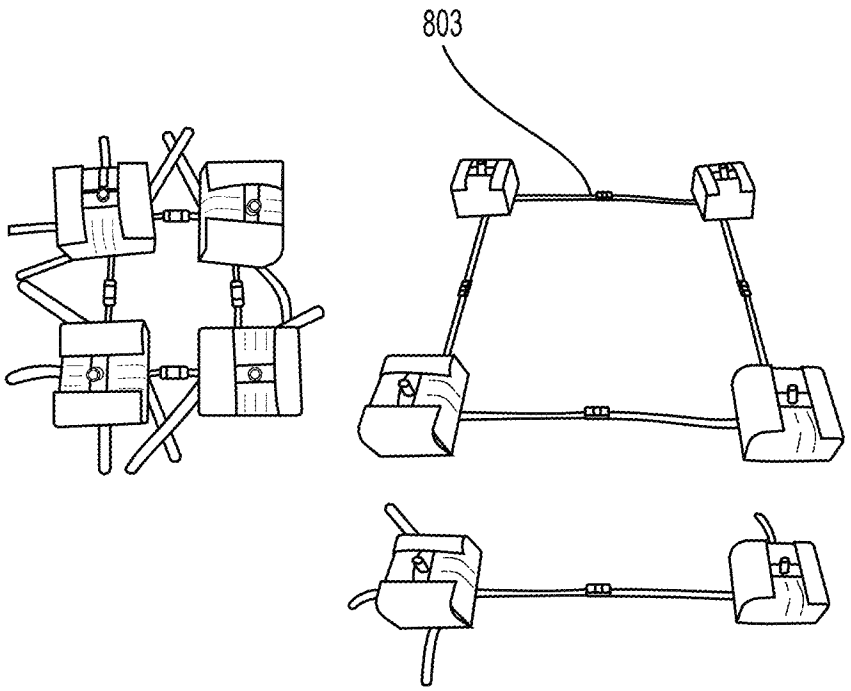
FIG. 8 shows a view of various attachment features.
Figure 8:
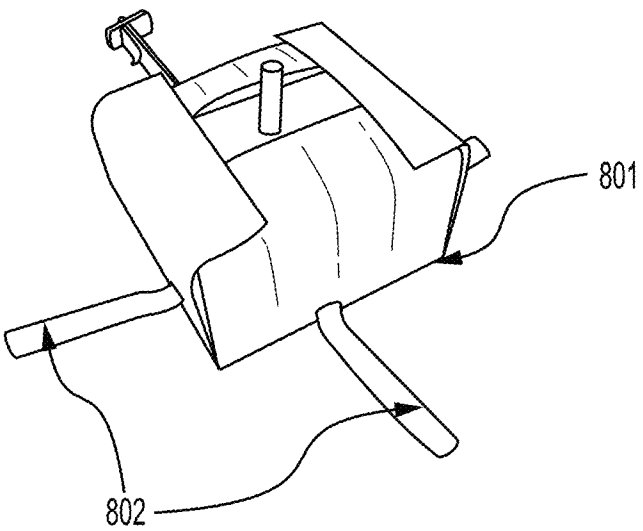

FIG. 8 shows a view of various attachment features. In an illustrative embodiment, the bottom surface may have adhesive such as hydrogel or "gorilla snot" 801 attached thereto. A fixed length of adjustable straps 802 can be nailed or screwed through to attach to a target. Charges can be carried by affixing clips 803 to a personal kit and then assembled together with clips 803 and adjusted at a target prior to attachment. In an illustrative embodiment, the maximum length of the straps 801 can be adjusted during manufacture to prescribed lengths for optimum spacing on target.

Although the invention has been described in detail with reference to certain preferred embodiments, variations and modifications exist within the spirit and scope of the invention as described and defined in the following claims.

The invention claimed is:

1. A multi-configuration transportable demolition pouch comprising:

a cruciform shaped section of fabric comprising a central explosive containing area and four trimmable flaps;

a fastener on each of said trimmable flaps;

a strap accepting slit positioned at a junction between each of said trimmable flaps and said central explosive containing area;

a first and a second strap;

a fabric lid comprising a fastener and a centered priming hole; and a first energetic device comprising a packed explosive, a sheet explosive, and a detonation cord wrapped around and secured to said sheet explosive; or a second energetic device comprising, in order, a packed explosive, a first sheet explosive, a wave shaper, a second sheet explosive, and a detonation cord wrapped around and secured to said second sheet explosive;

wherein said first or said second energetic device is placed in said central explosive containing area, said trimmable flaps are trimmed to secure said first energetic device in said central explosive containing area in a pouch configuration, said fabric lid is positioned on top of said trimmable flaps, said detonation chord is passed through said centered priming hole, and said straps are passed through said strap accepting slits and tightened;

wherein said first energetic device, when detonated, provides a central detonation point causing hemispherical detonation wave propagation to produce an expanding blast zone; and wherein said second energetic device, when detonated, said wave shaper creates an interrupted hemispherical detonation wave that causes detonation propagation to travel to outer edges of said packed explosive to produce a reduced footprint blast zone.

2. The multi-configuration transportable demolition pouch of claim 1, wherein said pouch further comprises one or more attachment features.

3. The multi-configuration transportable demolition pouch of claim 1, wherein said wave shaper can be immersed in water to provide water tamping to reduce blast effects.

* * * * *